US006142426A

United States Patent [19]

Zaro et al.

[11] Patent Number: 6,142,426

[45] Date of Patent: Nov. 7, 2000

[54] CROSSING GATE COUNTERWEIGHT ADJUSTMENT

[76] Inventors: Thomas R. Zaro, 1103 Wood St., Bethlehem, Pa. 18018; Scott D. Jones, 1109 E. Tilghman St., Allentown, Pa. 18105; Glen F. Seng, 3113 Weidasville Rd., Orefield, Pa. 18069

[21] Appl. No.: 09/173,211

[22] Filed: Oct. 15, 1998

[51] Int. Cl.[7] ..... B61L 29/00

[52] U.S. Cl. ..... 246/125; 246/261; 49/49; 74/89.15; 16/400

[58] Field of Search ..... 49/49; 16/400; 248/280.11, 292.11; 901/48; 246/125, 127, 261, 292, 293, 473.1; 74/89.15

[56] References Cited

U.S. PATENT DOCUMENTS 4,067,523 1/1978 Kenny et al. ..... 246/125
4,090,685 5/1978 Pappas ..... 246/125
4,512,208 4/1985 Lipinski et al. ..... 74/89.15
5,910,192 6/1999 Pulford et al. ..... 74/89.15

*Primary Examiner*—Mark T. Le
*Attorney, Agent, or Firm*—Charles A. Wilkinson

[57] ABSTRACT

A screw-threaded counterweight adjustment apparatus is journaled in end journals provided with brackets for attachment to the interior of a railroad crossing gate arm casing preferably by jam-type threaded fittings. A traveler is threaded over an elongated helically threaded rod rotatably mounted in the journals. A guide on one side of the traveler fits in an adjustment slot in the casing and a counterweight supporting rod or pin extends from the guide for attachment and support of the counterweights. The helically threaded rod is manually rotated by a wrench or by a motor to move the traveler and guide longitudinally on the counterweight section of the gate when it is desired to adjust the position of the counterweights.

23 Claims, 9 Drawing Sheets

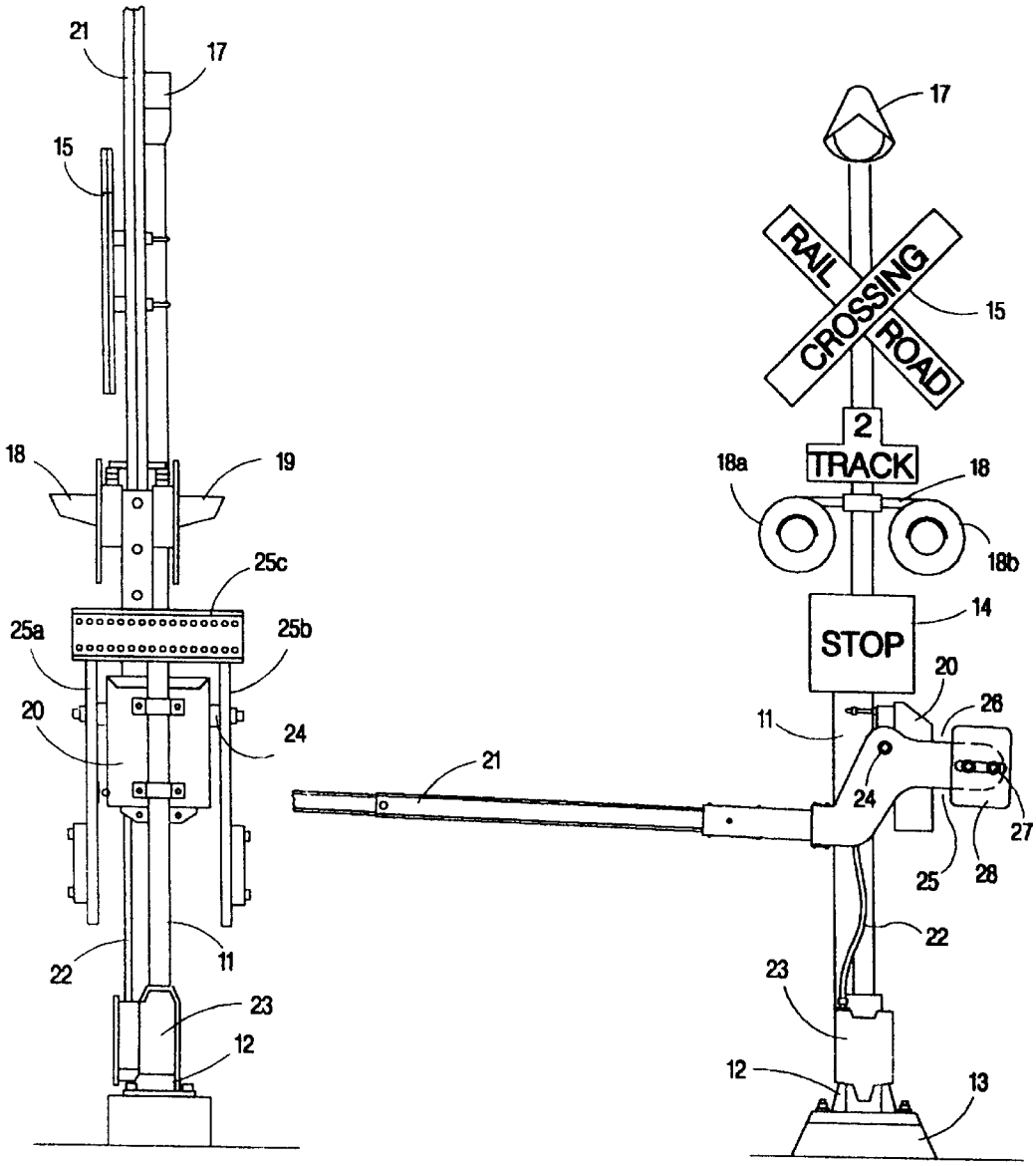
Fig. 2
PRIOR ART
Fig. 1
PRIOR ART
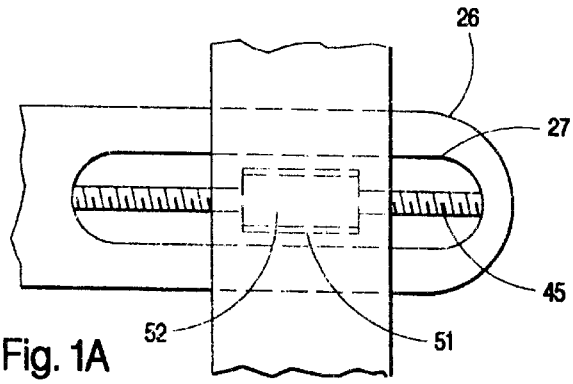
Fig. 1A 40
41
42
43
44
45
46
47
49
51
52
53
27
28
67

CROSSING GATE COUNTERWEIGHT ADJUSTMENT

BACKGROUND OF THE INVENTION

1. Field of the Invention

This invention relates generally to protective guards for railroad crossings and more particularly to lift-type or rocking-type gate mechanisms for use at railroad crossings where the gate mechanism is counterbalanced with external weights to enable a smaller or less powerful motor to be used to operate such gate.

2. Prior Art

Railroad crossings are guarded with three principal types of protective apparatus to prevent vehicles moving on intersecting roads from being struck by passing trains. Such protective apparatus comprises primarily marker signs, flashing and frequently audible signals and/or automatic gates that, when lowered, extend over or across the road to block access to the railroad tracks at the crossing by vehicles. In prior years, there were also watchmen at heavily traveled railroad crossings, whose job it was to direct traffic to stop by means of hand-held signs or signals or frequently by the use of manually-operated, vertically or horizontally swinging gates. Manually-operated, vertically swinging gates were largely hand cranked and provided with a large gear ratio which seriously restricted the speed with which a gate could be deployed or operated. With the development of automatic motor-operated equipment to activate the gate mechanisms, the more costly watchmen or gatemen have almost universally been replaced by automatic gate apparatus.

In hand-cranked gates, the blocking arm of the gate was customarily counterbalanced by a counterweight or, more usually, multiple counterweights supported on the opposite end of the gate arm to counterbalance the weight structure and relieve as much weight or stress as possible from the gateman. With the disappearance of the gateman, such counterweights have become even more important, since it is desirable to use as small a motor as possible to efficiently raise and lower the gate, while at the same time pivoting the gate as rapidly or quickly as possible consonant with not moving so fast as to endanger pedestrians and vehicles. Pedestrians and vehicles should preferably not, of course, be struck by a descending gate; nor should a gate be struck by a rapidly moving vehicle. Rapid operation of the gate requires that the speed of the customary electric motor powering the gate should not be reduced so drastically by gearing to obtain effective gate operating power that the gate will not operate sufficiently quickly to provide an effective barrier. Counterbalancing of the gate, therefore, becomes even more important for automatic gates in order that the motor operating the gate has as little effective weight to move as possible. A perfectly, or near perfectly, balanced gate may require practically no power at all to swing up or down at a reasonable speed. Customarily, counterweights for gates have comprised separate weights which can be applied or removed as necessary. The weights are quite frequently rectangular metal plates of different sizes and weight attached or clamped to the gate structure by some arrangement that allows the weights to be reasonably frequently moved longitudinally on the gate structure to adjust their counterbalancing effect as well as to allow the weights to be interchanged with other weights to make gross adjustments in counterbalancing. Minor adjustments are usually made by moving the longitudinal position of the weight on the gate structure, while gross adjustments may be made by interchanging the weights. Typical modern counterweight arrangements for railway crossing gates are shown in the following U.S. Patents:

U.S. Pat. No. 1,911,405 to Taylor et al. (1933)

U.S. Pat. No. 2,598,196 to Staley (1952)

U.S. Pat. No. 4,067,523 to Kenney et al. (1978)

U.S. Pat. No. 4,090,685 to Pappas (1978)

Each of the above patents shows a gate structure with a groove in the rear gate casing or arm into which a bolt-type fastening may be inserted to clamp a counter weight or a series of counterweights in place. The Taylor et al. patent actually supports the weights on a special bracket that is adjustably clamped or held in place by the tightening of the bolt-type fastenings and the other three patents disclose the use of counterweights supported or held directly upon bolts extending through a slot in the casing of the gate. Such slot provides a channel along which the threaded fastenings or bolts may be moved when loosened to adjust the counterweights and supporting threaded fastenings along the slot in order to provide various effective lever arm configurations with respect to the effective weight of the counterweight applied to balance the weight of the gate arm. The weight of the counterweight in the Staley patent is arranged to be adjustable along a slot disposed more or less transverse to the gate arm to primarily adjust the force with which the gate is held aloft when in an upraised position. The relative counterbalancing of such arrangement is, however, relatively less adjustable when the gate is lowered. The other three listed patents disclose adjustment slots that are disposed essentially in line with the longitudinal extent of the gate arm itself. The arrangement of the counterweights shown in the U.S. Pat. Nos. 4,067,523 and 4,090,085 patents to Kenney et al. and Pappas respectively, show essentially the present state of the art of counterweight adjustment, although such patents were issued more than twenty years ago. The principal alteration in the modern counterweight systems is that the weight may be held by a single threaded member more frequently than by two as is more typically shown in most of the older apparatus.

While the arrangement shown in the Kenney et al. and Pappas patents is quite effective in providing an adjustable counterweight arrangement that, once it has been correctly adjusted, is very effective in balancing the gate arm so it can be moved quickly and economically with a minimum of power, it is relatively difficult to adjust the counterweights themselves, since such counterweights are not only quite heavy, but also awkward to handle. Since the gate arm is itself relatively heavy, the counterbalancing weights are also by necessity heavy, at least if a reasonable length counterweight arm is to be used. Consequently, maintenance personnel must not only loosen the fastenings holding the counterweights in place, but must support the heavy counterweights until they are repositioned and resecured. Since the counterweights are, furthermore, usually adjusted with the gate in a raised position to avoid interfering with traffic, frequently the gate structure itself must be supported while the counterweights are manhandled into position. This is both a time-consuming operation and fraught with opportunities for injury of the adjustment personnel ranging from hernias, strained backs, pulled tendons and the like, to crushed toes and fingers as well as other injuries too numerous to list. Furthermore, since the adjustment of the counterweights is heavy work, usually at least two maintenance workers are assigned to the job and frequently half a day or more is expended in adjusting one gate or set of gates. Furthermore, since adjusting the gate counterweights frequently takes a considerable time, the crossing normally protected may be partially unprotected during the adjustment operation. There is, therefore, a definite need for a method or apparatus or both that will facilitate adjustment of the counterweights on a gate structure.

OBJECTS OF THE INVENTION

It is an object of the present invention, therefore, to provide an improved counterbalance adjustment for pivoted railroad gates.

It is a further object of the invention to provide a counterbalance adjustment for railroad gates which can be retrofitted into the gate structure or casing of existing gates.

It is a still further object of the invention to provide a relatively inexpensive, easily mounted adjustment for the counterbalance weights of a pivoted railroad gate.

It is a still further object of the invention to provide a pivoted railroad gate having an easily implemented mechanical adjustment for counterbalancing weights provided on such gate.

It is a still further object of the invention to provide a retrofitted counterbalance for a railroad gate based on a screw adjustment principle.

It is a still further object of the invention to provide a counterbalance for a railroad crossing gate which will prevent injuries to personnel assigned to make periodic adjustments to the counterbalancing of such gate.

It is a still further object of the invention to provide a readily mounted screw-type adjustment for counterbalance weights normally carried on the exterior of a gate casing.

It is a still further object of the invention to provide a counterbalance adjustment arrangement for a gate structure incorporating a threaded adjustment screw mounted lengthwise of the gate structure with a traveler or weight pin support provided with a shoulder or guide operating in a slot normally already provided in the gate structure such that the counterweight or weights are subject to minimum play and prevented from sudden shifting during operation of the gate so that maximum control of the gate operation is maintained.

It is a still further object of the invention to provide a counterweight adjustment mechanism for pivoted railroad gates comprising a combination of a threaded adjustment rod provided with an internally threaded traveler having an integral guide adapted for receipt in the groove of a counterweight attachment slot on a gate arm.

It is a still further object of the invention to provide a simple retrofitable counterweight adjustment mechanism for attachment to a gate arm with a minimum or no change whatever to the gate arm.

It is a still further object of the invention to provide a sturdy weather and vandal resistant counterweight balancing mechanism for a railroad crossing gate arm.

It is a still further object of the invention to provide a counterbalance adjustment mechanism for railroad gate arms that can be readily and easily adjusted periodically either manually or by the application of power means to the threaded adjustment rod.

Other objects and advantages of the invention will become apparent from review of the following description in conjunction with the appended drawings.

BRIEF DESCRIPTION OF THE INVENTION

The present invention is directed to a readily-adjusted, screw-type mechanism by which the counterbalance plates or weights of an existing railroad crossing gate may be adjusted without significant manual shifting or support of either such weights or the gate structure. A screw-type adjustment means is adapted for mounting within or upon the casing of an existing gate preferably by a jam-type clamping arrangement. The screw of the adjustment means is adapted for mounting longitudinally with respect to the overall structure of the gate casing and to be readily adjusted by a wrench-type tool applied at the end of the casing. A counterweight support arm or arms mounted upon the screw mechanism extends through a slot in the side of the casing and serves as a movable support for the counterweight plates or other types of counterweight on the exterior of the casing. The screw member is mounted in two (2) journal end supports which are in turn jam clamped or otherwise secured within the casing, preferably by means of sharpened grips which extend laterally from the journals for the screw adjusting mechanism. The counterweight support arm is provided with a close fitting guide that moves within the usual groove provided for clamping the customary counterweight into the gate casing.

In an alternative embodiment, particularly in a gate structure comprised of a steel plate-type gate arm rather than an aluminum or iron casting in the form of a casing, the journal pieces for the ends of the threaded members may be attached directly to the surface of the metal gate arm rather than jam secured or otherwise secured within the cast gate arm structure. The threaded adjustment rod will usually be adjusted manually by means of a wrench-type tool, but may also be attached to a motive means particularly if an automatic balance detection apparatus or means is incorporated into the gate with or without telecommunication to a central office or monitoring center.

BRIEF DESCRIPTION OF THE DRAWINGS

FIG. 1 a side elevation of a typical railroad crossing gate structure into which the apparatus of the present invention may be fitted.

FIG. 1A is a side view of a gate arm with the retrofit of the present invention fitted into it, illustrating that the outside appearance of the gate is changed hardly at all by the installation of the counterweight support of the invention. The guide portion of the gate arm support is shown in FIG. 1A in phantom behind the counterweight.

FIG. 2 is an end elevation of the gate structure shown in FIG. 1 with the gate in raised position and either conventional counterweights or the adjustable counterweight arrangement of the present invention applied.

DESCRIPTION OF THE PREFERRED EMBODIMENT

Figure 3:
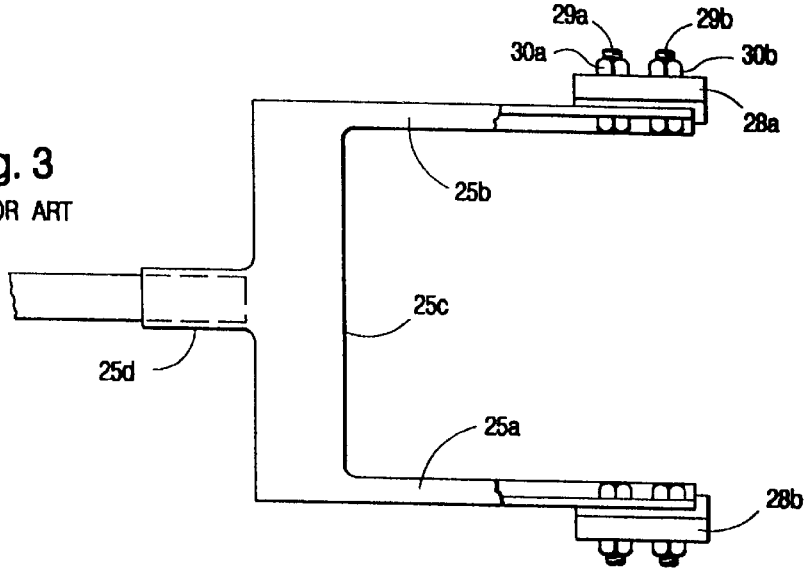
Fig. 3 PRIOR ART
FIG. 3 is an enlarged top elevation of the bifurcated gate counterweight arm shown in FIGS. 1 and 2.

Automatic railroad gates are used at many crossings where a road intersects a railroad track. Such gates are frequently in isolated or even more or less inaccessible places where they may have to be run from battery power or, in some modern installations, solar charged battery power and, in any event, it is always desirable to reduce the power necessary to operate these gates. Consequently, the typical railroad gate is accurately or finely counterbalanced with a weight so that only a relatively small rotary electric motor is necessary to move the gate either up or down using a minimum electric current. Adjusting the gate so that it is readily moved by a low horsepower motor requires frequent adjustments and readjustments. Such necessary adjustments are due to changing weather conditions, particularly changing temperatures with changing seasons, absorption of moisture by a wooden gate member or snow accumulation, wear and tear on the operating motor, or change of the power system, such as current source variations as well as other factors which may easily throw a gate out of balance. Other factors which may disturb the balance or require readjustment include broken or damaged gates due to being struck by a vehicle or damage to the gate due to vandalism. Consequently, almost all crossing gates are provided with a counterbalance arrangement whereby weights on the rear of the casing of the gate will counterbalance the weight portion or gate arm portion of the gate itself and allow it to be moved upwardly, in particular, with relatively little applied force or use of power.

Unfortunately, as indicated above, gates, when they are finally adjusted, are difficult to maintain in adjustment. Consequently, it is frequently necessary for maintenance personnel to attend to such gates and readjust the usual counterbalance plates longitudinally upon the gate in order to attain an accurate balance of such gate. A gate, however, is a relatively heavy structure and, as a result, the counterbalance weights also need to be quite heavy, particularly if the counterbalance arm is not to be excessively long in order to obtain maximum leverage. Adjusting such counterbalance weights, which are usually in the form of rectangular heavy metal plates, normally entails releasing a jam bolt-type fitting or large threaded fitting, which normally maintains the counterbalance weights in a particular longitudinal position with respect to the gate structure and then moving such counterbalance weights to a different longitudinal or other position on the gate structure, at which point the large bolts or other fastening means are retightened manually, usually while physically lifting or maintaining the counterbalance weights in a proper position, until the large screw-type or the bolt-type securing means is thoroughly tightened. Since the counterweights are quite heavy, there is a large weight to be supported by the maintenance personnel while the counterbalance weights are released from the gate structure. As a result, many injuries of maintenance personnel could occur during the process of adjusting the counterbalance weights on gate structures as well as a great deal of time being wasted in accurately adjusting such weights. It is not unusual for a manual adjustment of the weights on a gate to take several hours, incurring a very significant cost in manpower in addition to the large probability that the maintenance personnel involved may be injured, such personnel being particularly subject to strained muscles, hernias and other like injuries while adjusting the counterweights.

The present invention has been developed particularly to alleviate the injury and time problems associated with adjusting the previous counterbalance arrangements for railroad gates. The apparatus of the invention comprises a longitudinally threaded rod mounted within or upon the counterweight portion or arm of the gate. Such threaded rod is rotatably mounted, or journaled, usually at both ends, in free running or lubricated journals which are securely attached to the counterweight arm such that the threaded rod has a major axis along the length of the counterweight portion of the gate arm. An internally threaded traveler upon which is mounted or which carries a shoulder or guide is movably mounted or threaded upon the threaded rod with the guide piece or section entered into the groove into which the threaded bolts customarily supporting counterweight plates normally fit. Extending from the guide is a counterweight pin or rod adapted to support the counterweights, which are usually the normal or usual rectangular plates customarily used for counterbalancing gate mechanisms. There will usually be only one counterweight pin in keeping with more modern counterweight systems. However, the guide or traveler may accommodate twin counterweight pins more like the usual older counterweight installations. In many cases, however, a single counterweight pin will be substituted for the older two pin arrangements when retrofitting an existing gate. The guide piece which fits in the counterweight slot will, in most cases, be rectangular, preferably with slightly radiused corners to prevent binding in the event of slight cocking or misalignment in the guide slot, and its dimensions will closely match the transverse dimension of the slot in order to provide an effective support of the counterweights, which, if they were to swing free, would be subject to positional displacement with resulting misbalancing of the counterweight system. In some installations, the rectangular guide can be substituted for by two adjacent round or oval guides, or even in proper cases, by a single round or oval guide adapted to travel along the slot closely confined in such slot to stabilize the position of the counterweight plates. In a preferred retrofit arrangement, the journals at the end of the threaded rod or other points on the threaded rod are mounted in brackets equipped with jam-type threaded fasteners, preferably with sharp, pointed ends extending toward the sides and adapted to jam fit the apparatus within a cast or molded aluminum casing. However, the journals can also be attached by threaded fastenings to the molded aluminum casing or cast iron casings or to a more or less flat metal plate such as a steel plate which may in a substantial number of cases constitute the counterweight extension portion of the gate. The threaded rod is preferably provided with an angular wrench engageable head at one end by which the threaded rod may be turned in order to cause the traveler to move along the rod carrying with it any counterweights mounted thereupon. In some installations a motor may be used to rotate the threaded adjustment rod, particularly if a balance detector is provided on the gate which is able to transmit the detected balance data to a central location from which impulses to operate the balance motor may be transmitted. A self-balancing installation is also possible.

By the use of the counterweight adjustment of the invention, the gate counterweights can be readily adjusted longitudinally along the counterweight arm in order to redistribute the counterbalance weight of the gate arm and may be readily adjusted by only one man with a wrench adapted to fit the wrench engageable end of the threaded member without separate physical support of the weights or the exertion of any significant physical effort. In cases of motor activation of the adjustment mechanism suitable adjustments may be made merely by button operated hand controls and the like.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. It should be understood that the primary description of the construction and use of the product will be in connection with a more or less standard gate arm or arms. The device of the present invention is intended, however, to be used with any other gate arm construction to which it can be accommodated or adapted.

In FIG. 1, there is shown a typical more or less complete railroad crossing gate and signal installation for warning motorists and pedestrians on a street or road intersecting the track of approaching trains. A pole or mast 11 having a base 12 is securely fastened by anchor bolts or the like to a suitable concrete foundation 13 which is located alongside of the roadway at the crossing site. The mast 11 supports and carries the customary warning devices, such as a "stop on red signal" or merely "stop" as shown, on sign 14, a pair of cross arms or so-called "cross bucks" 15 bearing the designation "railroad crossing", an audible signal in the form of a bell 17 at the top of the mast 11 and two pairs 18 and 19 of, usually red, flashing lamps 18*a* and 18*b* and 19*a* and 19*b* which emit visual signals. See FIG. 2 in which flashing light 19*a* is obscured by light 19*b*. The mast 11 also supports and carries a gate-operating mechanism 20 which moves an elongated lightweight gate arm 21 between a horizontal traffic obstructing or blocking position illustrated in FIG. 1 and a vertical non-obstructing or clear position illustrated in FIG. 2. An electric motor, a gear train, an output shaft, a circuit control, a hand clear brake, etc., not shown, are all suitably mounted and housed within the metal case of gate-operating mechanism 20. The gate mechanism may be of the type described in U.S. application Ser. No. 770,523, filed Feb. 2, 1977 by Spiro J. Pappas, entitled "Grade Crossing Assembly", now U.S. Pat. No. 4,090,685. The motor is powered by a suitable source of electrical voltage which is conveyed to housing 20 via flexible conduit 22 from junction box 23. The ends of the main output shaft 24 extend out of the sides of housing 20 and are adapted to carry a pair of gate supporting arms 25*a* and 25*b*. Each of the arms 25*a* and 25*b* is an aluminum or aluminum alloy casting having a circular hole located at substantially its center of gravity for fitting on the ends of shaft 24. An internally splined steel insert, not shown, is fitted in the hole in each gate supporting arm and is attached or kept in place by six bolts (not characterized). The arms 25*a* and 25*b* are fitted onto inserts, not shown, on the shaft 24 and held in place by suitable locking nuts and washers. The aluminum gate supporting arms 25*a* and 25*b* each includes a heel or rear portion 26 which includes a slot or elongated aperture 27 for accommodating an attachment for a counterweight 28*a* and 28*b*. The counterweights are selectively bolted to the arms by a pair of bolts and nuts 29*a* and 29*b* which pass through two holes or apertures in the counterweights and also slot 27 in the arms and are secured to the counterweights 28 by threaded nuts 30*a* and 30*b*. See FIGS. 3 and 4. Thus, by loosening the nuts 30*a* and 30*b*, the counterweights may be shifted to the right or left to offset or counterbalance the weight of the gate arm 21 which can vary from time to time due to seasonal temperature changes affecting the length of the members, humidity if the gate itself is wood, as it frequently is in order to allow for easy fracture and replacement, if struck by errant vehicles and the like, and from other causes. The other end or toe portion of each of the cast aluminum alloy gate supporting arm 25*a* and 25*b* are arranged to receive a gate arm adapter bracket or crosspiece 25*c* which has a gate arm bracket 25*d* extending from one side. See FIGS. 2 and 3. In FIGS. 1 and 4, the heel 26 of the gate arm 25 or 25*a* is shown in phantom behind the counterweight or weights 28 attached to it.

Figure 4:
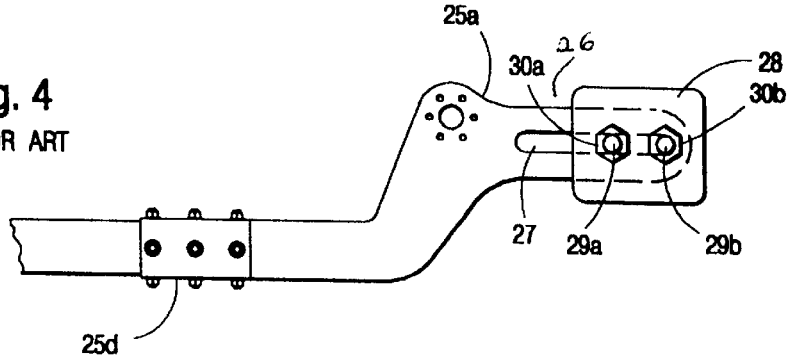
Fig. 4 PRIOR ART
FIG. 4 is an enlarged side view of the gate counterweight arm shown in FIG. 3.
Figure 5:
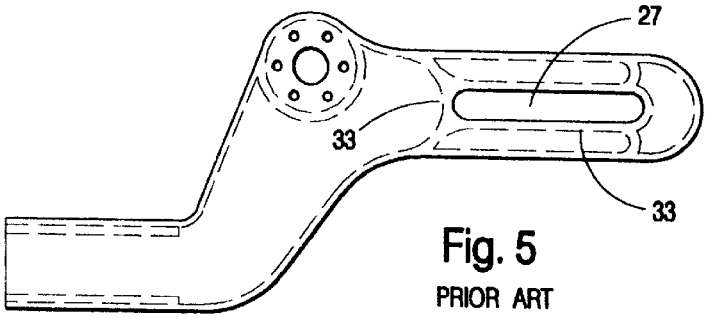
Fig. 5 PRIOR ART
FIG. 5 is an outside elevation of the gate counterweight arm shown in FIG. 4, the cast internal structure of the arm being indicated in phantom by broken lines.
Figure 6:
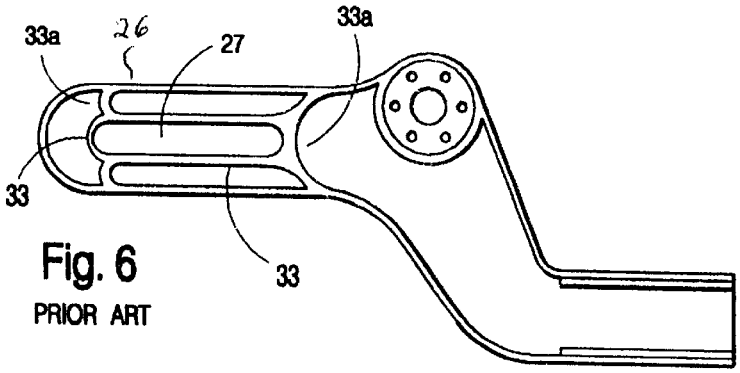
Fig. 6 PRIOR ART
FIG. 6 is an inside side view of the counterweight arm shown in FIG. 5.

The arms 25*a* and 25*b* with attached counterweights 28 are shown in enlarged scale from the top and side in FIGS. 3 and 4, respectively, and are shown by themselves as cast, but before installation on a gate structure in FIGS. 5 and 6. The view is from the outside of the cast aluminum arm in FIG. 5, showing in phantom by broken lines, cast reinforcing extensions or ribs 33 and from the inside in full lines in FIG. 6. It can be seen in FIG. 5, and particularly in FIG. 6, how cast ribs 33 surround the slot or elongated aperture 27 to reinforce such aperture or slot through which the support bolts 29 for the counterweights 28 normally extend.

Figure 7:
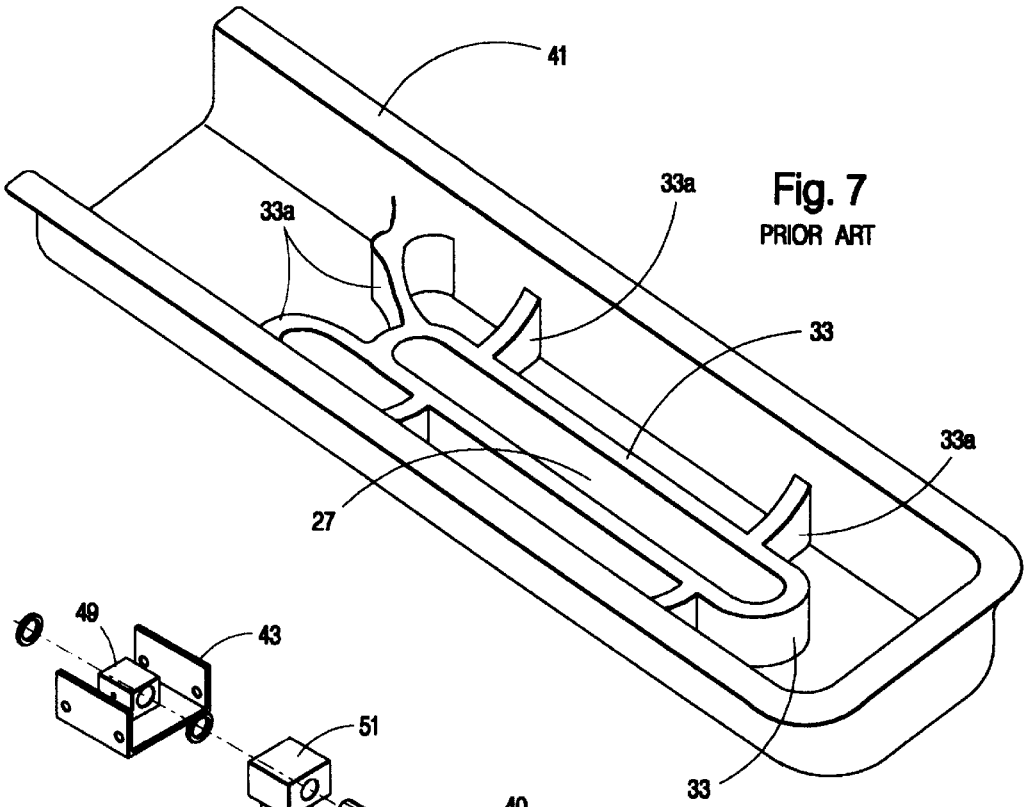
Fig. 7 PRIOR ART
FIG. 7 is an enlarged isometric view of a portion of a portion of a similar counterweight arm casing shown from the inside to better illustrate the internal structure of the casing shown in FIG. 6.

FIG. 7 is an enlarged isometric view of the inside of the central portion of the aluminum casting or casing 41 forming the major portion of the heel 26 of a typical gate arm 25 similar to that shown in FIGS. 5 and 6, further illustrating the ribs 33 generally reinforcing the slot 27. Auxiliary reinforcing ribs 33*a* serve to further reinforce the ribs 33.

Figure 8:
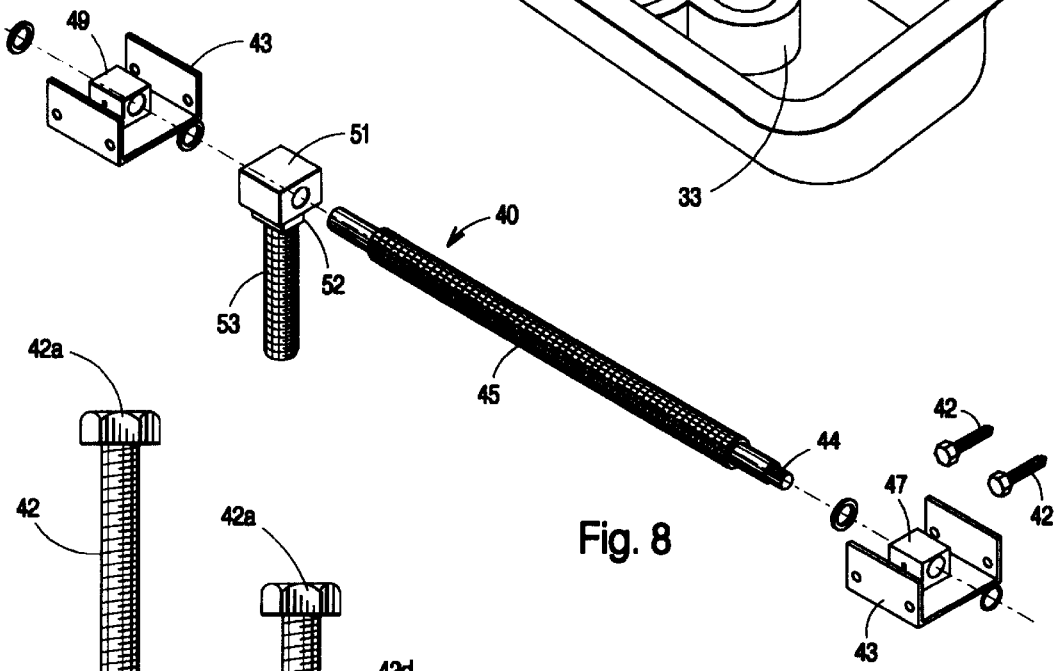
FIG. 8 is a partially disassembled view of a preferred embodiment of the counterweight adjustment mechanism of the invention.
Figures 9, 9A, 10:
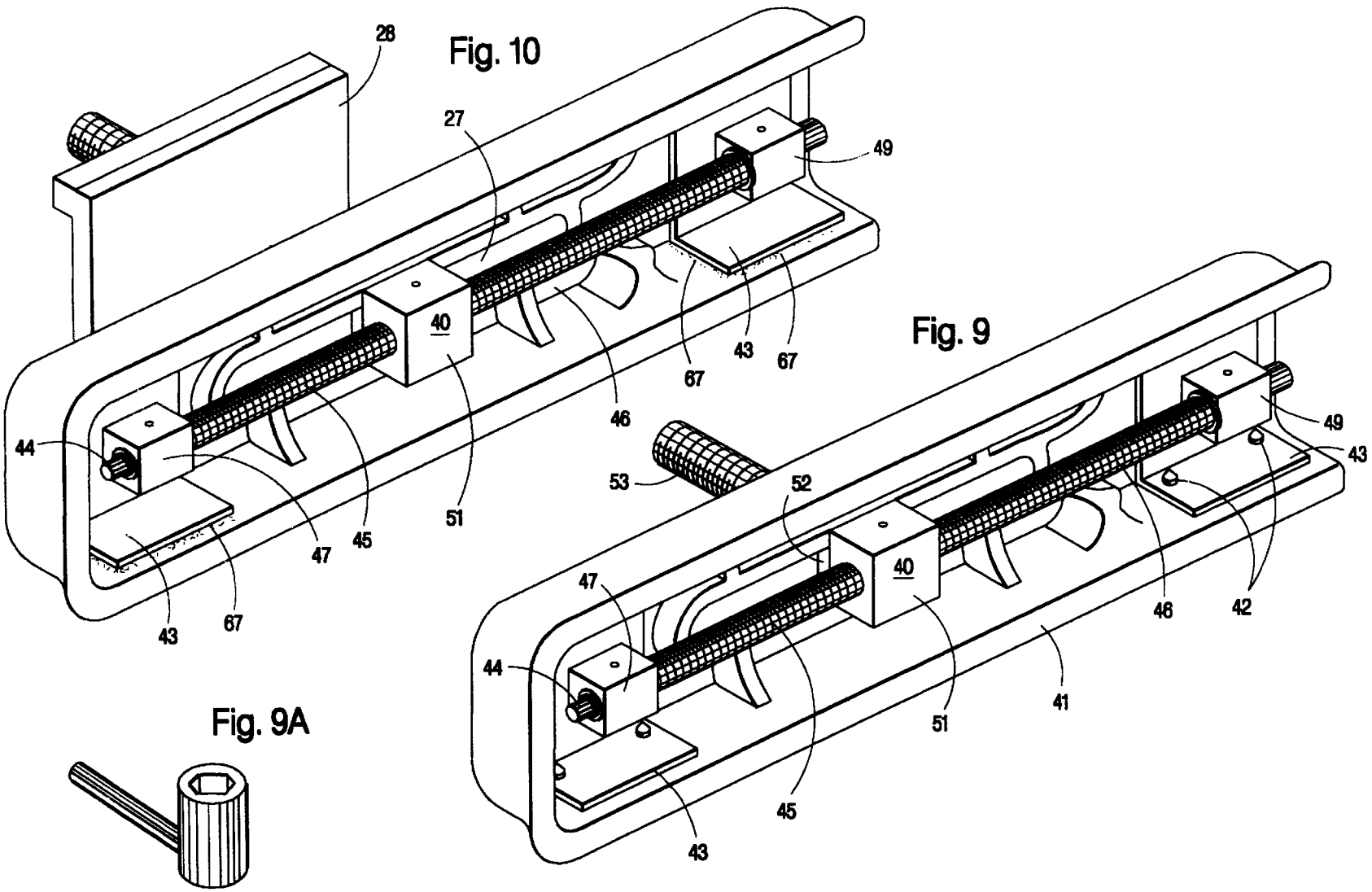
FIG. 9 is an isometric view similar to FIG. 7 showing the counterweight adjustment apparatus shown in FIG. 8 in accordance with the invention mounted within the casing of a railroad crossing gate arm. The gate arm casing is substantially identical to that shown in FIG. 7.
FIG. 9A is an isometric view of a suitable manual or hand wrench for use in rotating the screw mechanism of the counterweight adjustment mechanism of the invention.
FIG. 10 is an overall view of a typical gate adjustment arm similar to that shown in FIG. 9 with the adjustment apparatus of the invention mounted within such gate and with the counterweight plates mounted in place on the counterweight support arm as well as the brackets supporting the bearings being welded or soldered within the casing.
Figures 11, 12:
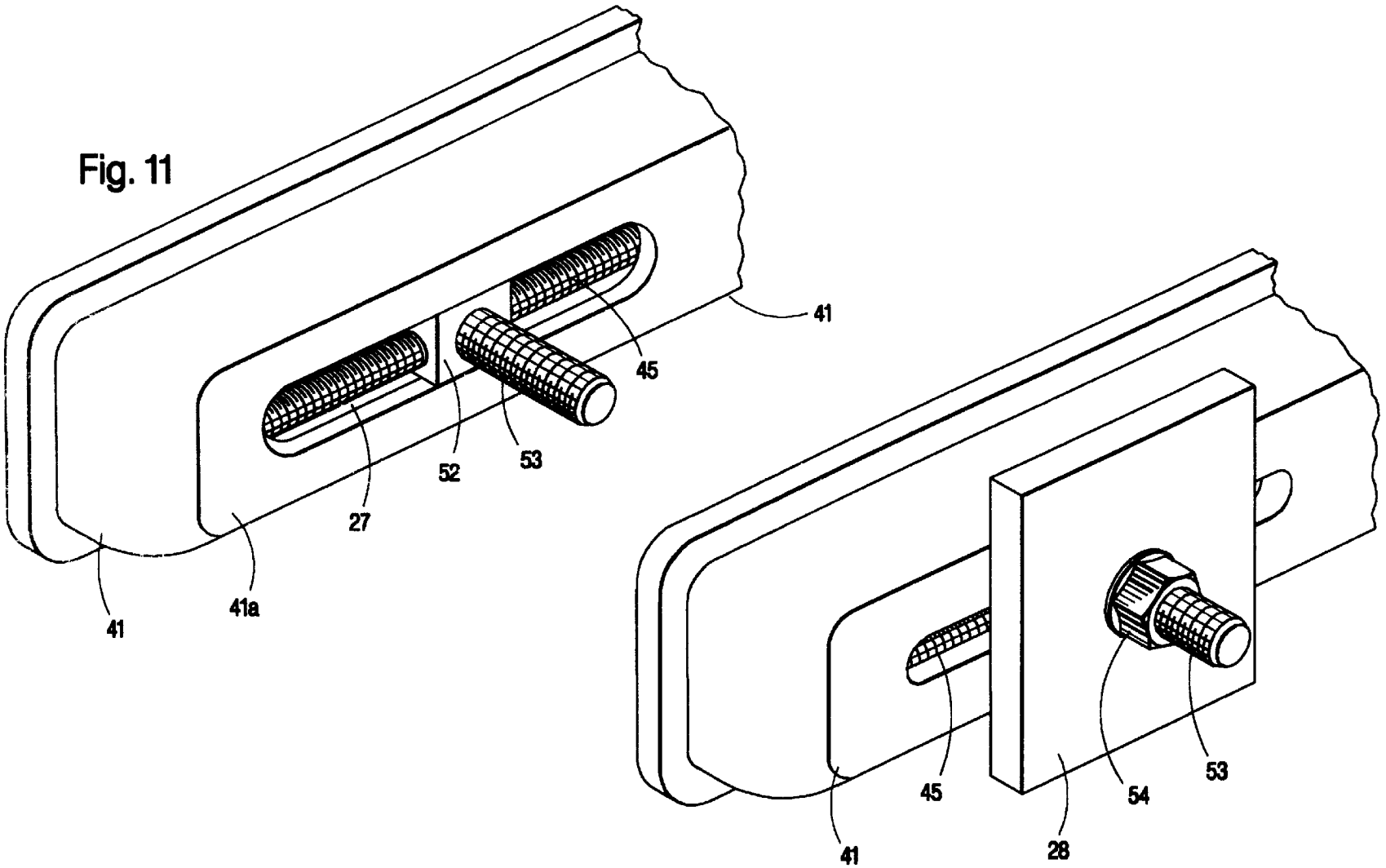
FIG. 11 is an isometric view of the gate arm casing with the adjustment apparatus of the invention mounted thereon as shown in FIGS. 9 or 10, but shown from the opposite side from that shown in FIG. 9 or 10.
FIG. 12 is an isometric view similar to FIG. 11 but showing the counterweight mounted on the counterweight support arm still viewed from the opposite side from that shown in FIG. 10.

The present invention has been developed especially to alleviate the previous problems in adjusting the counterweight means on railroad crossing gates. As shown particularly in FIGS. 8 and 9, which respectively show in isometric views the screw adjustment apparatus of the invention, both partially disassembled (see FIG. 8) as well as assembled or mounted as shown in FIG. 9 in the interior or the back of the cast gate arm casing structure 41 forming the heel 26 of the gate arm 25 as shown previously particularly in FIG. 7. Such adjustment apparatus comprises a screw mechanism 40 mounted within the gate arm casing 41, as shown more particularly in FIG. 9, by means of jam-type screw threaded extension means 42 (see also FIG. 8) extending oppositely from the journals 47 and 49, or as shown particularly in FIG. 9 from brackets 43 in which the journals 47 and 49 are supported in the gate arm casing 41 at both ends of a rotatable threaded rod or screw 45 of screw adjustment mechanism 40. In FIG. 9, the jam-type screw threaded extension means 42 are shown for convenience as slotted head threaded members. A traveler 51 may be adjusted along the rotatable threaded adjustment rod 45 as well as the casing 41 by rotating such adjustment rod 45 by means of a wrench-engaging angular head 44 at one end of the rotatable screw-threaded rod 45, such head either extending partially from the casing to facilitate turning of such head 44 or which may be recessed in the casing 41 and reachable by means of an extension head on a wrench, such as the wrench head shown in FIG. 9A. In FIG. 9 in particular and as indicated above, the gate casing is indicated as 41 and the retrofitable adjustment means is indicated as 40 overall. The retrofitted adjusting means 40 comprises, as shown and described briefly above, a central screw or rotatable threaded rod 45 which is journaled at both ends in preferably well-lubricated journals 47 and 49 at the ends of the central screw 45 and provided with helical threads 46, which may desirably be so-called Acme machine threads. At the outer end of the gate casing closest to the viewer as shown in FIGS. 9 and 10, the central adjustment rod 45 near the end wall of the gate arm casing 41 is provided with a hexagonal or other angular head 44 adapted for engagement by a wrench head of any suitable type. A suitable wrench head is shown in FIG. 9A. Other wrench heads can equally well be utilized depending upon the form of the angular head 44. Journaled upon the threaded portion 46 of the screw adjustment means or threaded rod 45 is an internally screw-threaded adjustment fitting or traveler 51 from one side of which there extends outwardly through the adjustment slot 27 a rectangular guide 52, with a counterweight support arm or traveler pin 53 extending outwardly from the rectangular guide 52 as partially shown in FIGS. 8, 9, 10 and especially FIG. 11. Such counterweight support arm or traveler pin 53 will have some retaining or clamping means on the end to prevent counterweights 28 mounted upon such arm or pin from falling off and at the same time, abut such counterweights 28 or an intermediate washer or the like, not shown, against the guide 52 to prevent the counterweights from jamming against the gate arm casing 41 adjacent the adjustment slot 27. See, for example, FIG. 12, where a retaining means in the form of a threaded nut 54 holds the counterweight 28 against the top of the guide 52, which, as shown in FIG. 11, extends slightly beyond the surface of the casing 41 to allow direct contact with the rear surface of the counterweight 28 to provide sufficient clearance to allow the counterweight free movement adjacent the slot 27 and out of contact with the surface 41a of the casing 41.

Figure 8A:
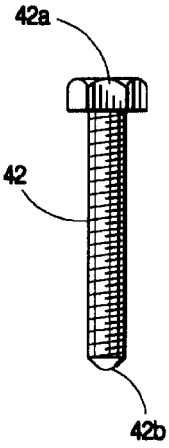
FIG. 8A is an elevation of a sharpened threaded jam bolt preferred for securing the journals of the apparatus of the invention into a cast gate arm casing.
Figure 8B:
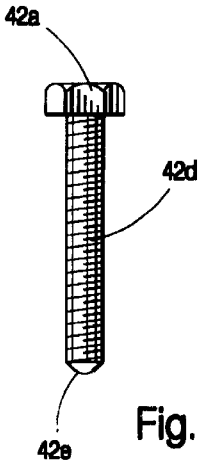
FIG. 8B is an elevation of a rounded end threaded jam bolt for securing the journals of the apparatus of the invention into a gate arm casing.

The journals 47 and 49 are provided with screw-threaded movable jam members 42 extending preferably from brackets 43 upon which the journal members 47 and 49 are mounted. The screw threaded adjustment rod 45 is freely rotatably mounted at its ends in the journal members 47 and 49. As shown in FIGS. 8 and 9 brackets 43 are preferably either short channel sections or formed with a general channel configuration, upon the bottom or middle section 43*a* of which the journals 47 and 49 are secured and into the side flanges 43*b* of which the jam members 42 are threaded. The screw-threaded jam members 42 preferably have a hexagonal head portion 42*a* as shown in FIGS. 8, 8A and 8B which may be turned by a suitable wrench or other suitable tool to urge the ends of the jam members 42 against the sides of the gate arm casting or casing 41 and effectively clamp the brackets 43 and attached journals 47 and 49 within the metal casting or casing 41 comprising the heel 26 of the gate arm 25. Such screw-threaded jam members 42 are preferably sharpened on the outer ends 42*b*, as shown in FIG. 8A, which is an enlargement of one of the jam members 42. However, such rotatable jam members 42 may less desirably have merely blunt or rounded ends to hold the journals within the casing of the gate arm. FIG. 8B shows a jam-type member such as this in which the jam-type member 42*d* has a rounded or other than sharp end 42*e* which may be forcefully jammed against the inside of the gate arm casing to hold the brackets 43 with attached journals 47 and 49 in place. It has been found that a series of sharp end rotatable jam members in particular very easily maintains one of the counterweight adjusting means of the invention rigidly within the gate casing, assuming that the rotatable jam members 42 are forcefully pressed against the sides of the casing so that the sharp ends almost imperceptibly penetrate the material of such gate casing. This is particularly effective where the material of the casing is a softer aluminum alloy material, but is also effective in other materials such as cast iron. An alternative arrangement in which the jam members 42 are merely slotted head studs 42*g* is shown in FIG. 9 for convenience in illustration. An angled screw driver or other suitable tool may be used to turn such studs. As will be understood, however, a hex or other suitable wrench cooperating with a contoured or angled head on the threaded member such as shown in FIG. 8 will usually be more convenient.

Once the screw-threaded counterweight adjustment means or assembly 40 of the invention is jam fitted within the gate casing, the threaded central adjustment rod 45 may be easily rotated by engagement of a wrench, such as shown in FIG. 9A, with the hexagonal or other angular wrench engaging head 44 so that the traveler 51 may be easily adjusted along the threads 46 of the central adjustment screw 45 to any desired position within the slot 27 in the casing 41. The counterweight support arm or pin 53 may, therefore, be easily adjusted longitudinally together with the counterweights held upon such arm by rotating the central screw member or rod such that the counterweight support arm or traveler pin 53 is either moved forwardly with respect to the gate arm structure, or rearwardly with respect to the gate arm structure by means of a suitable wrench means which interengages with the hexagonal end of the screw adjustment member. Once the screw adjustment is accurately positioned, it will stay in approximate position for relatively long periods of time so that frequent readjustments are not necessary. Even more importantly, such adjustments can be made very quickly and without placing any strain upon personnel making such adjustments, particularly upon the regular maintenance personnel who would normally make any adjustment. Consequently, many, many injuries are prevented and many man hours are conserved in maintaining the crossing gates by the use of the present invention.

The adjustment means of the invention may be formed of stainless steel or other corrosion-resistant material so that such adjustment means may be easily left at least partially exposed to the weather without danger of corrosion. In the event that the material of the adjustment means was not corrosion resistant, long term use might result in corrosion of the threaded member, in particular, as well as its journals and the traveler 51, which could lock such threaded member and traveler in position and destroy its usefulness in adjusting the weights or counterweights of the gate adjustment means. Of course, if the rear of the gate arm was closed and other expedients for sealing the mechanism were taken, the use of corrosion-resistant materials might not be as important.

FIG. 10 shows a similar arrangement to that shown in FIG. 9 but with the flanges or sides 43*b* of the brackets 43 suitably welded or soldered to the sides of the gate arm casing 41 instead of being jam secured to the sides of the casing by the jam members 42*g* shown, for example, in FIG. 9.

FIGS. 11 and 12 show the outside or closed side of the heel of the gate arm casing 41 and illustrate that from the outside of the gate casing, the adjustment means of the invention is essentially invisible except for a portion of the adjustment screw 45 and the guide 52 which extends slightly above the surface 41*a* of the casing or, in other words, protrudes slightly from the slot 27. FIG. 11 shows, in particular, the gate arm casing 41 from the outside or slot 27 side with the adjustment apparatus of the invention installed on the inside before the counterbalance weights are placed upon the weight support arm or pin 53 and clearly shows the guide member 52 mounted in the slot 27. FIG. 12, on the other hand, again shows the gate arm casing 41 from the outside, but with a counterweight 28 slipped over the counterweight support arm or pin 53, with an outer female threaded fastening 54 placed upon the counterweight pin or support 53 such that the counterweight is secured by female threaded fastening 54 preferably through a washer 54*a*. As noted above, the weight 28 is secured or pressed directly against the slightly protruding top of the guide 52 by the force of the fastening 54 so the weight 28 is freely moveable along the casing 41 rather than jammed against such casing.

FIG. 9 shows, by contrast, that as viewed toward the inside of the gate arm casing, the adjustment means 40 may be exposed completely to the weather, and if such adjustment means is not formed of corrosion-resistant metal, significant corrosion, particularly of the screw threads, may take place and significant harm may be done to efficient operation. Alternatively, the gate casing itself rather than being open, as is widely customary, might be closed on the inside or off side as well as on the outside and the adjustment mechanism might, if the slotted openings from the casings accommodating longitudinal movement of the counterweight support arm or pin 53 are sealed by rubber gaskets or the like, be made of less corrosion-resistant materials. However, since the adjustment means is meant for long-term service, frequently in out-of-the-way places, it is usually best to provide a corrosion-resistant metal to construct such adjustment means, since allowing the adjustment means to remain visible to maintenance personnel allows it to be inspected as it is used, and also generally decreases the cost of installation and use.

Figure 17:
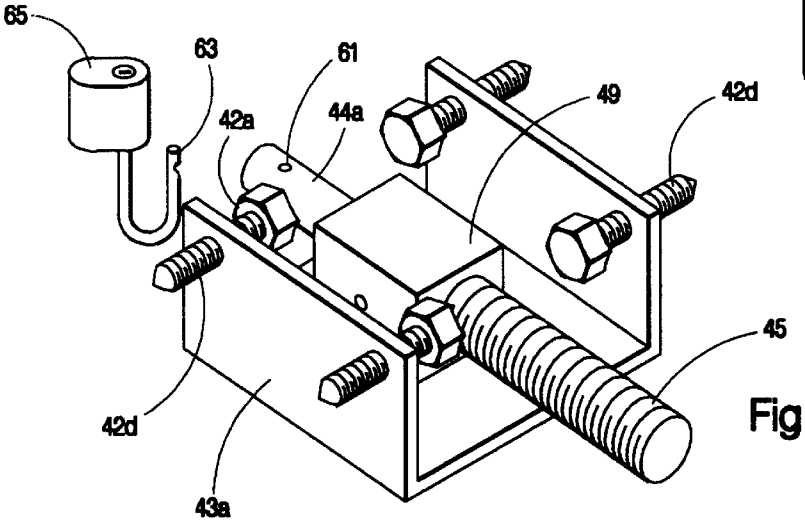
FIG. 17 is an isometric enlargement of the journal on one end of the adjustment mechanism with an extended end of the threaded adjustments rod extending beyond the journal having an orifice to receive a locking mechanism and attachment means such as shown in FIG. 9B extending from the side brackets.

If it is desired to inactivate the screw adjustment so that only authorized maintenance personnel will be able to adjust it in order to discourage vandalism, a suitable locking arrangement may be provided. Such vandalism might include adjusting or altering the adjustment mechanism to over balance the gate so it will either not go up or not come down, both of which could have serious repercussions. The off end 44*a*, or opposite end from the wrench engaging end 44, of the threaded adjustment 45 can include an orifice 61, as shown in FIG. 17, through which a pin 63, which may be the shank of a large padlock 65 or the like, may be inserted to block rotational movement of the threaded adjustment member 45 by contact of the lock body with a portion of the bracket 43.

The invention is shown, as indicated above, partially disassembled in FIG. 8, wherein the same reference numerals are used to indicate the various parts of the screw-type mechanism. Other arrangements for retrofitting the mechanism within the gate structure may be used or the arrangement may be mounted as an original installation in a gate, for example, by replacing the jam-type threaded members or fittings with bracket extensions which are welded within the casing of the gate. Such an arrangement, as noted above, is shown mounted within a gate structure in FIG. 10 wherein it will be noted no orifices are shown in the sides or flanges 43 of the brackets 43 for reception of rotary jam-members and instead weld material 67 is visible along the edges of the brackets 43.

The arrangement of the invention provides a very efficient and convenient means for adjusting the counterbalance weights normally mounted upon a gate structure with a minimum of effort, either by special adjustment by counterbalancing personnel or by regular crossing maintenance personnel. Because of the minimum force needed to make the adjustment and the elimination of any necessity to support the counterbalance weights as they are being adjusted, many injuries to maintenance personnel are prevented and considerable man hours are saved by the use of the adjustment means of the invention, since the adjustments can be easily and quickly made by only one maintenance person, whereas frequently at least two maintenance persons are necessary to make the adjustments in the usual gate structure. Not only is only one man or woman easily able to make the typical adjustment with the apparatus of the invention, but such personnel can make the adjustments much more quickly than was possible heretofore. The counterbalance weights themselves do not have to be supported at all, except by the counterbalance adjustment means itself, and the counterbalance weights can be moved longitudinally along the gate by a simple rotation of the screw mechanism which provides its own leverage (since a screw is a type of leverage device) to decrease the force necessary to move the counterweight. Quick, efficient adjustment of the counterweights also decreases the amount of time that a gate may be rendered inoperative for adjustments, thus increasing the safety of the entire system.

Figures 13, 14:
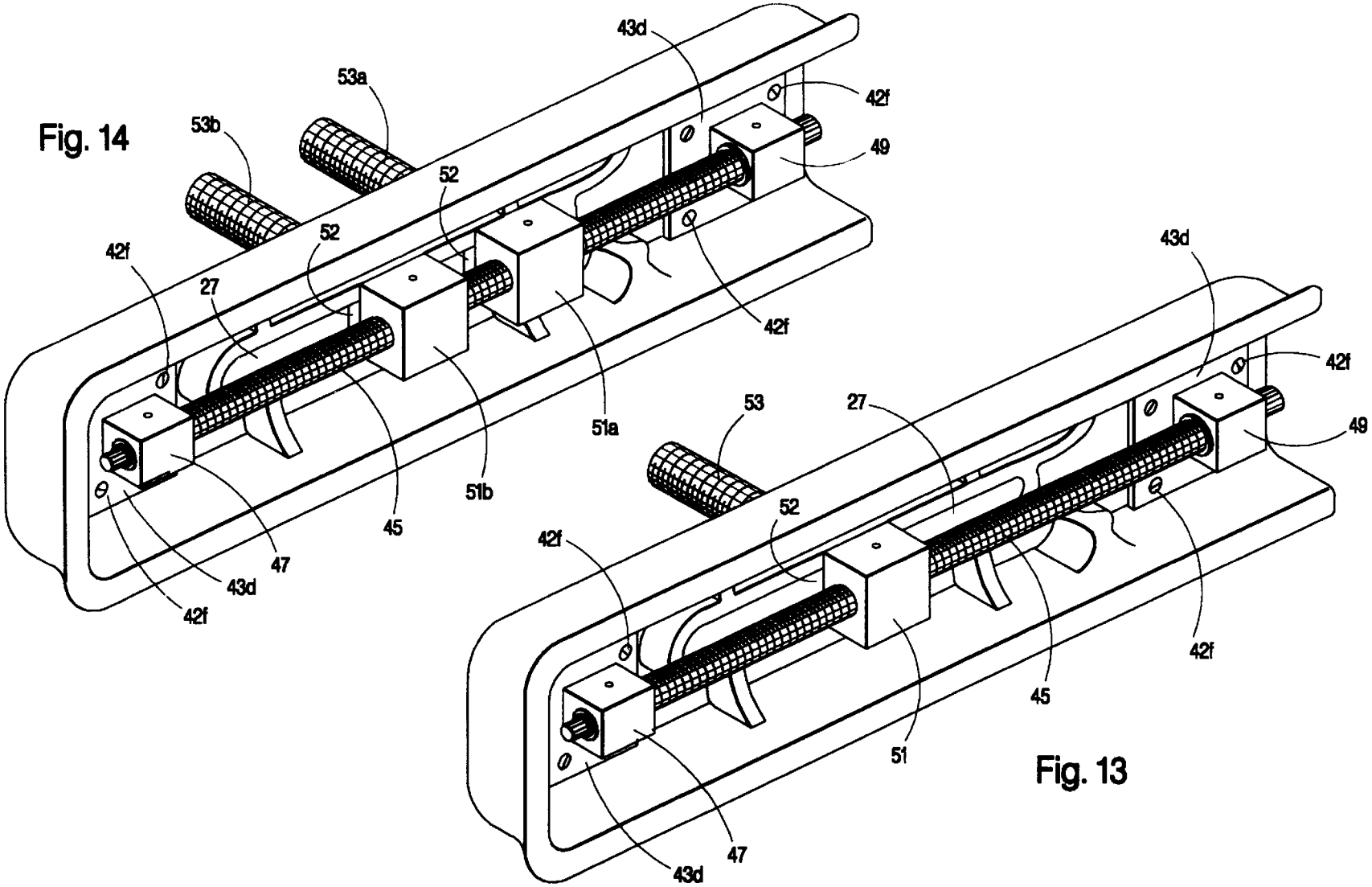
FIG. 13 is an isometric view of the adjustment apparatus of a further embodiment of the invention with the screw journals mounted by conventional tapped screw threaded fastenings in the casing of the gate arm.
FIG. 14 shows an alternative embodiment of the invention similar to that shown in FIG. 13, but in which there are two combined traveler and guide sections threaded onto the threaded rod to support counterweights in a level position in the more usual double support arrangement of some older gate structures.

FIG. 13 is an isometric view of a further embodiment of the invention in which the journal members of the adjustment mechanism of the invention are mounted upon flat bracket members 43*d* which are in turn attached by suitable machine bolts 42*f*, shown as slotted head bolts, or other suitable fastening means, to the bottom of the casing 41 of the gate arm structure. The adjustment mechanism may be left completely in the open on one side as shown or the open side may be covered by a suitable plastic or metal cover, not shown, adapted to fit over the back side of the gate arm casing.

FIG. 14 is an isometric view similar to FIG. 9 in which instead of there being only one traveler 51, there are instead two more or less side-by-side travelers 51*a* and 51*b*. Since these travelers are threaded onto the same threaded rotary adjustment member with the same internal thread inclination, they will be carried along the adjustment arm or screw 45 in unison with each other, both carrying a rectangular guide 52 and both carrying a separate counterweight support arm or pin 53*a* and 53*b* along with them, the two support arms usually carrying, however, the same counterbalance weights which will have two rather than only one counterbalance support orifice in them. The two orifices serve to keep the counterbalance weights lined up evenly on the gate arm, although the actual efficiency of the counterbalancing arrangement is not significantly changed. As will be readily recognized, the two travelers 51*a* and 51*b* instead of being two coordinated travelers, could be attached directly together or could, for that matter, constitute the two or opposite ends of a single traveler carrying two counterweight support arms or pins 53*a* and 53*b* and usually two rectangular or other shape guides, although these also can be combined together into a single guide.

So far as the guides 52 are concerned, such guides need only be designed to fit more or less snugly into the groove 27 so the traveler is efficiently guided along the groove and the counterweight support arm or pin 53 is stabilized. While, with a single guide in particular, it may be desirable to have such guide constructed generally as a longitudinally extended block such as a rectangular guide dimensioned to fit in the groove 27 to maintain stability of the entire structure, it will be understood that when there are two separate guides operating in coordination along a groove or extended opening, that the guides themselves can be essentially almost any shape such as rectangular, oval, round or other shape which in combination with the adjacent guide provides a general longitudinal alignment of the two guides and, therefore, of the counterweight support arms or pins secured to them.

Figures 13A, 14A:
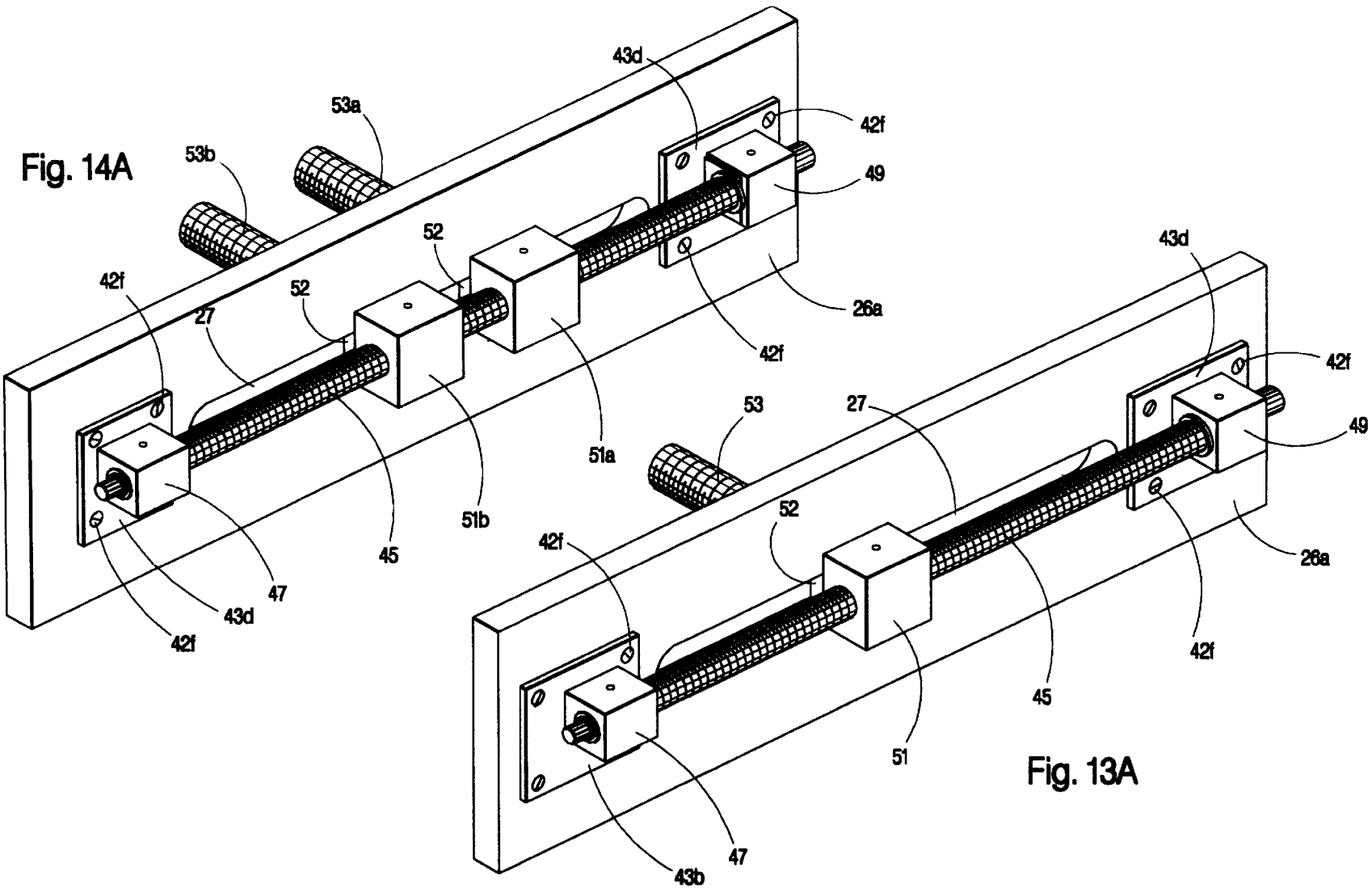
FIG. 13A an isometric view of the adjustment apparatus of the further embodiment of the invention shown in FIG. 13 mounted upon a flat steel plate-type counterweight arm.
FIG. 14A shows an alternative embodiment of the invention similar to that shown in FIG. 14 in which there are two combined traveler and guide sections threaded onto the threaded rod to support counterweights in a level position as shown in FIG. 14, but the adjustment apparatus of the invention is mounted upon a flat steel plate-type counterweight arm as shown in FIG. 13A.

FIG. 13A is an isometric view of a further embodiment of the invention in which the journal members of the adjustment mechanism of the invention are mounted upon flat bracket members 43*d* which are in turn attached by suitable machine bolts 42*f*, shown as slotted head bolts, or other suitable fastening means, as shown also in FIGS. 13 and 14, to a flat steel heel of a gate arm structure 26*a*. The adjustment mechanism may be left completely in the open as shown in FIG. 13A or may be covered by a suitable molded plastic or metal cover, not shown, adapted to fit over the back side of the flat steel gate arm or heel of a gate arm and at least partially enclose the adjustment mechanism. The gate arm itself or heel of the gate arm would typically be formed of a heavy steel plate.

FIG. 14A is an isometric view similar to FIG. 14 in which as in FIG. 14 instead of there being only one traveler 51, there are instead two more or less side-by-side travelers 51*a* and 51*b*, mounted, however, upon a flat steel plate-type gate arm rather than within a cast casing-type gate arm. As in FIG. 14, since these travelers are threaded onto the same threaded rotary adjustment member with the same internal thread inclination, they will be carried along the adjustment arm or screw 45 in unison with each other, both carrying a rectangular guide 52 and both carrying a separate counterweight support arm or pin 53*a* and 53*b* along with them. The double traveler adjustment arrangement shown in FIG. 14A is like the single traveler arrangement shown in FIG. 13A but, as indicated above, attached or mounted upon a flat steel gate arm structure 26*a*. As in FIG. 13A, the adjustment apparatus can be left open as shown or at least partially enclosed by a molded plastic or metal cover. As in FIG. 14, the two travelers 51*a* and 51*b* instead of being two coordinated travelers, could be attached directly together or could constitute the two or opposite ends of a single traveler carrying two counterweight support arms or pins 53 and usually two rectangular or other shape guides, although the guides could also be combined together into a single guide.

It will be understood that the bracket arrangement shown in all of FIGS. 13, 13A, 14 and 14A are essentially all similar in that the bracket pieces 43 are attached directly to the bottom of a casing or alternatively to a flat steel plate arm, preferably by threaded bolts 42*f*. Otherwise, and other than for the double traveler shown in FIGS. 14 and 14A the adjustment mechanisms shown in FIGS. 13, 14 and 13A and 14A are essentially all exactly the same.

Figure 15:
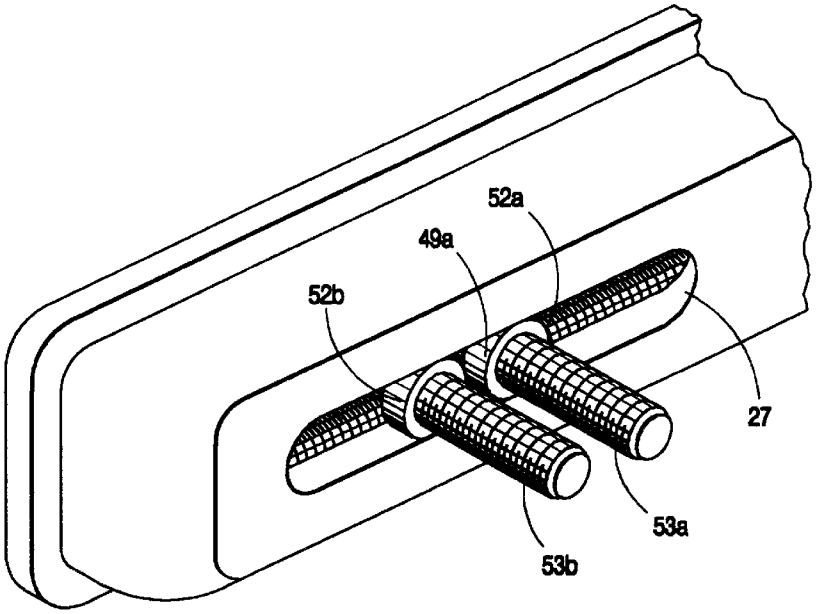
FIG. 15 shows an isometric view similar to that of FIG. 11 but wherein the embodiment of the invention includes two combined traveler and guide sections and support arms and the traveler and guide sections take the form of two substantially circular or oval guides which are mounted to travel together in the slot of the gate casing with twin counterweight support arms extending from such guides.

The use of other than rectangular guides is more particularly shown in FIG. 15 where two essentially cylindrical guides 52*a* and 52*b* are shown mounted upon a single traveler 51. There are in this case two counterweight support arms 53*a* and 53*b* extending from the two guides 52*a* and 52*b*. However, it will be understood that there could be only one counterweight support arm extending out from between the two cylindrical guides. Alternatively with somewhat less stability there could only be one cylindrical guide, particularly if the threaded adjustment rod 45 is fairly sturdy. It will also be understood that the guides 52*a* and 52*b* or a single guide replacing them could not only be cylindrical but could be oval, ovoid or other shape with less probable efficiency, but still acceptable as a guide as long as the height of the guide is essentially only slightly more or greater than the depth of the slot 27 in the gate arm.

Figure 16:
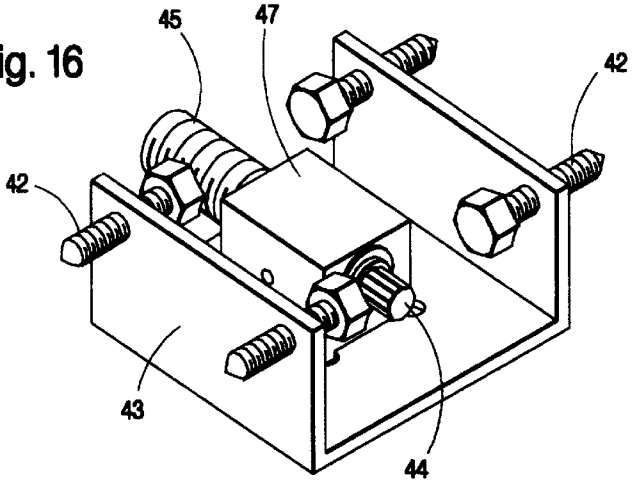
FIG. 16 is an isometric enlargement of one of the journals mounted upon a bracket with jam fastenings in place at the sides of the bracket to maintain the journal in place within the gate arm casing.

FIG. 16 is an isometric enlargement of journal 47 and bracket 43 showing the screw-threaded jam members 42 mounted in place upon the bracket 43 in position to be forced by rotation into the sides of the light metal of the aluminum or aluminum alloy or other metal of the casting forming the gate arm casing 41. The floor of the bracket 43 may be seen to be preferably partially cut out at 43*f* to receive the lower portion of the journal 47 to strengthen the construction overall and require less welding or soldering in order to provide a secure attachment or securing of the journal in the bracket 43. This is in accordance with conventional machined construction.

FIG. 17 is an isometric enlargement of the journal assembly comprising the journal 49 and the bracket 43*a*. In this assembly, the bracket 43*a* has threaded into it the round-faced jam members 42*d* having rounded ends 42*e* as shown in FIG. 8B which may be forcefully threaded against the sides of the gate arm casing 41. Engagement of the jam members 42*d* with the sides of the gate arm may be improved by forming a ground-out hollow in the inside face of the casing at the impingement point of the jam member or even by the provision of a shallow drilled orifice in the casing. Also shown in FIG. 17 is an extension 44*a* of the threaded adjustment member 45 beyond the journal 49. Such extension has an orifice 61 in it which can receive a suitable pin or, in the case shown, the hasp 63 of lock 65 such as a pad lock which will, when the lock is secured through the orifice 61, prevent the threaded adjustment member 45 from rotating, effectively inactivating the adjustment of the counterweights on the gate casing.

Figure 18:
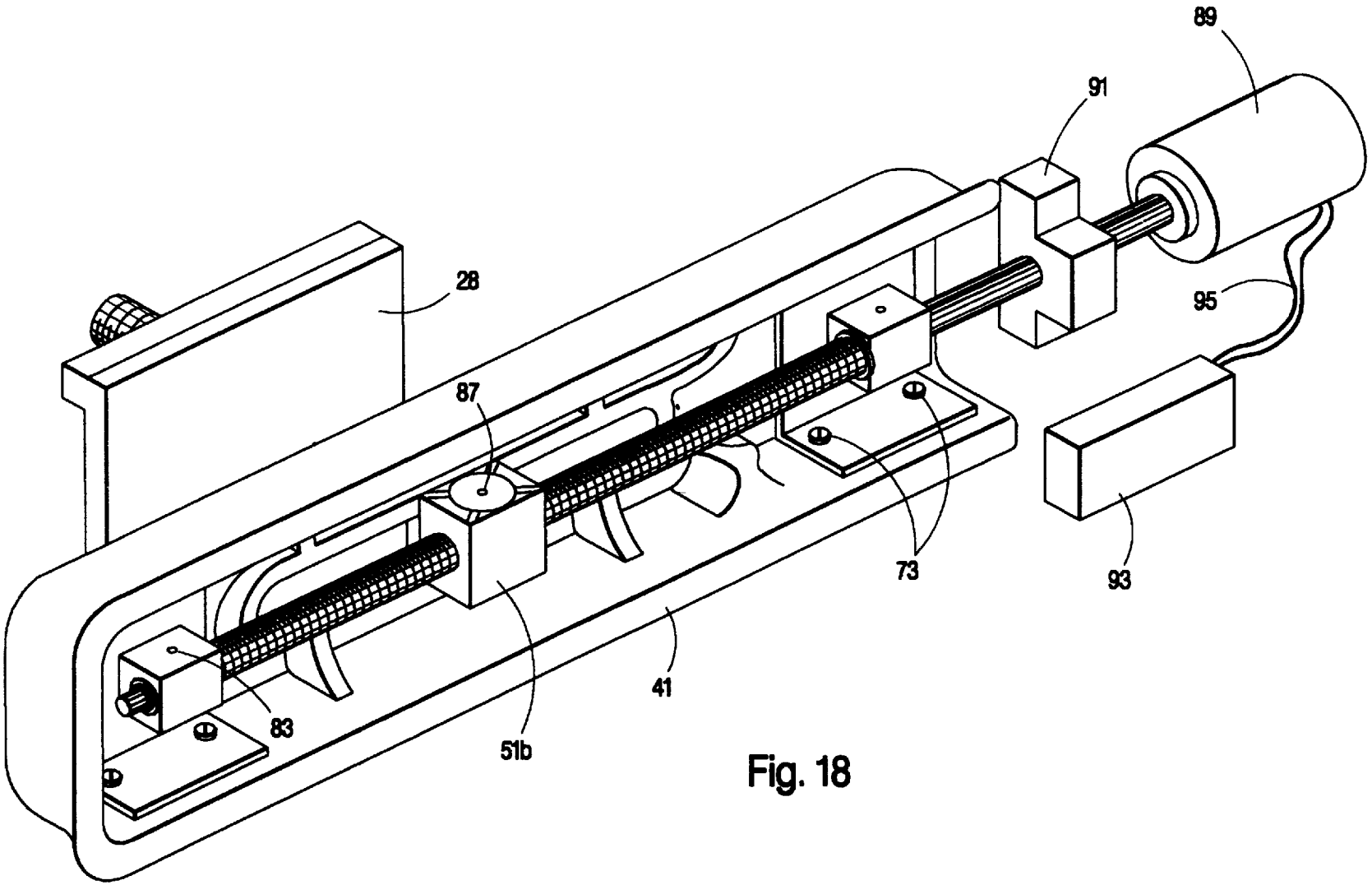
FIG. 18 is an isometric view of the adjustment mechanism similar to that shown in FIG. 10, but having a motor mounted at one end of the threaded adjustment member to rotate such member upon command.

FIG. 18 is a further isometric view similar to FIGS. 14 and 15 in which the brackets 43 are designed to be screwed or otherwise directly secured to the gate arm casing 41 via fastening openings, not shown, in which are shown fastenings 73, in this case the heads of slotted bolts in the sides 43*a* of the bracket. Such bracket 43 may also, as will be understood, be welded, soldered or otherwise directly attached to the wall of the gate arm structure as shown more particularly, for example, in FIG. 10.

In FIG. 18, the traveler 51*b* is rounded off on the edges and corners. Grease or lubrication openings 87 are provided in the upper portion of the traveler 51*b* plus the journals 47 and 49. A motor 89 and gear box 91 are also shown diagrammatically mounted or positioned at the outer end of the rotatable threaded member 45 to turn the threaded member moving the traveler 51*b* along the threaded member. The motor 89 may be operated by a control box 93 which it may be understood can be controlled either directly by a maintenance worker on the scene or may be operated remotely if a balance detection apparatus not shown is available to detect the balance of the gate and transmit such balance data to a central location from where such balance data can be used by a central operator to operate the motor 89 and balance the gate or can be applied automatically by telemetry or the like to the gate to maintain it in balance.

Figure 19:
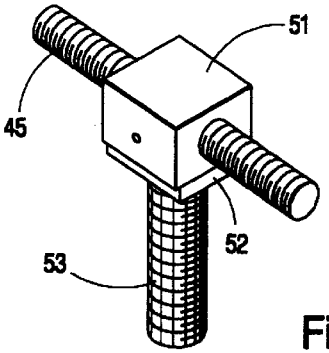
FIG. 19 is an enlarged isometric view of the traveler and guide mounting the counterweight support arm illustrating the combined and preferably integral construction of the traveler and guide sections as well as the counterweight support arm.

FIG. 19 effectively shows an enlarged isometric view of the traveler 51 on the threaded adjustment member 45 removed from the remainder of the apparatus clearly showing the preferred rectangular guide 52 which is adapted to be retained directly in the slot 27 in the keel of the gate arm in either a steel plate gate arm or cast gate arm. The positioning of the rectangular guide 52 in the slot 27 holds the traveler 51 in position on the threaded adjustment arm 45 and prevents the counterweights on the counterweight support arm 53 from being displaced from position allowing the counterweights to be moved longitudinally without being otherwise displaced from position and causing possible overbalancing one way or another of the gate arm. The guide 52 and particularly the rectangular guide serves a very important function, therefore, in the overall apparatus. As indicated above, the traveler 51 and guide 52 are preferably machined from a single piece of metal for strength and rigidity and it is advantageous also if the counterweight pin is also part of such unitary construction.

By the use of the counterbalance adjustment of the invention, the counterweights on a railroad gate may be very efficiently and effectively moved with a minimum expenditure of energy and brute strength, thereby improving the ease and efficiency of adjusting the counterweights to such an extent that such weights can be longitudinally adjusted by a single maintenance worker without danger of injury or strain to the adjustment personnel.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the applicable prior art and therefore to effectively encompass the intended scope of the invention.

What is claimed is:

1. A counterweight adjustment apparatus for adjusting the longitudinal position of counterweights upon a railroad gate crossing structure comprising:

(a) a pair of journals provided with means for attachment of said journals to a railroad crossing gate arm casing, (b) an elongated rotatable threaded member mounted within the journals for rotational movement about its longitudinal axis, (c) an internally threaded counterweight support assembly movably mounted upon the rotatable threaded member, (d) said counterweight support assembly including a traveler internally threaded to receive the elongated rotatable threaded member, a guide member adapted for sliding movement within a longitudinal counterweight adjustment slot also associated with the railroad crossing gate arm casing and a counterweight support means extending outwardly from said guide member and incorporating means thereupon for retaining counterweights, and (e) means provided upon the rotatable threaded member for interengagement with wrench means for rotating said threaded member.

2. A counterweight adjustment apparatus in accordance with claim 1 wherein the means for attachment of the journals to a crossing gate arm casing comprise threaded attachment means interengaged with the journal and the casing.

3. A counterweight adjustment means in accordance with claim 1 wherein the means for attachment to the interior of the crossing gate arm casing comprises jam engagement means.

4. A counterweight adjustment apparatus in accordance with claim 3 wherein said jam-type engagement means comprise threaded members which are adapted by rotation to have the ends of such members jammed into the sides of the interior of the gate arm casing.

5. A counterweight adjustment apparatus in accordance with claim 4 wherein the threaded members have sharpened heads adapted for at least partial penetrative engagement with the sides of the casing.

6. A counterweight adjustment apparatus in accordance with claim 4 wherein the counterweight adjustment apparatus is made from a corrosion-resistant metal allowing such counterweight adjustment apparatus to continue to be used over long periods of time even when exposed to the elements.

7. A counterweight adjustment apparatus in accordance with claim 6 wherein the means for attachment of said journals to the crossing gate casing is secured to the journal by an intermediate bracket.

8. An adjustment arrangement for a counterweight used upon a railroad crossing gate structure comprising:

(a) a counterweight support means adapted for longitudinal movement along a counterweight support portion of a railroad crossing gate apparatus guided by a slot guide associated with the railroad gate apparatus, (b) at least one elongated helically threaded member adapted by rotational movement about its longitudinal axis to bias the counterweight support means along the slot-type guide, (c) the counterweight support means having associated with it a means for attachment of gate counterweights to it, and (d) a means for rotating the elongated helically threaded member.

9. An adjustment arrangement for a counterweight in accordance with claim 8 wherein the counterweight support means is threaded upon the helically threaded member.

10. An adjustment arrangement for a counterweight in accordance with claim 9 wherein the counterweight support means incorporates a guide member adapted for movement along the slot-type guide.

11. An adjustment arrangement for a counterweight in accordance with claim 10 wherein the helically threaded member is journaled at both ends in journal means which are secured to the crossing gate structure on a counterbalance portion of said crossing gate.

12. An adjustment arrangement in accordance with claim 11 wherein the helically threaded member has a section on the end adapted for interengagement with a rotating means.

13. An adjustment arrangement in accordance with claim 12 wherein the rotating means is a wrench adapted to interengage with an angular wrench engaging section at one end.

14. An adjustment arrangement in accordance with claim 13 wherein the adjustment arrangement is secured to a gate casing by threaded fastener means.

15. An adjustment arrangement in accordance with claim 14 wherein the threaded fastener means is mounted in bracket means which support the journal means.

16. An adjustment arrangement in accordance with claim 15 wherein the threaded fastener means comprises jam securing means arranged to interengage with the sides of a gate casing.

17. An adjustment arrangement in accordance with claim 16 wherein the threaded fastener means have sharp penetrative ends for interengagement with the side of the casing.

18. A method of improving the adjustment of counterweights on a railroad crossing gate comprising:

(a) mounting within a counterbalance portion of a gate casing by means of threaded fastenings a helically threaded rod such that such rod extends longitudinally parallel to an adjustment slot already in the gate casing;

(b) the helically threaded rod having an internally threaded traveler thereupon which is adapted to be adjusted to be located upon the threaded rod at a location allowing a guide means attached to said traveler to be inserted into the adjustment slot for free movement along said slot, (c) mounting at least one counterweight upon a counterweight support means extending from said guide means to the opposite side of said slot from said helically threaded rod, and (d) securing said counterweight upon the counterweight support means whereby the counterweight can be moved along the casing adjacent the slot in the casing by rotating the helical threaded rod.

19. A method of improving adjustment of counterweights on a railroad crossing gate in accordance with claim 18 wherein the threaded fastenings used to mount the threaded rod within the counterbalance portion of the gate are jam fastenings which are thrust by rotation into the sides of the casing of the crossing gate to hold the helically threaded rod and associated apparatus in place.

20. A method of improving adjustment of counterweights on a railroad crossing gate in accordance with claim 19 wherein the helically threaded jam fasteners have sharp ends which are threaded into at least minimal penetrative relationship with the sides of the casing by rotative movement.

21. A method of improving adjustment of counterweights on a railroad crossing gate in accordance with claim 20 wherein the counterweights are held on the counterweight support means by a threaded interengagement arrangement.

22. A method of improving adjustment of counterweights on a railroad crossing gate in accordance with claim 21 wherein the counterweight support means and the guide member inserted into the adjustment slot for facilitating movement along said slot form d unitary member.

23. A method of improving adjustment of counterweights on a railroad crossing gate in accordance with claim 22 wherein at least one of the counterweight support means and the guide member attached to the traveler are bifurcated and are coordinated with respect to each other before being inserted into the adjustment slot in the casing.

* * * * *